US006886296B1

(12) United States Patent
John et al.

(10) Patent No.: US 6,886,296 B1
(45) Date of Patent: May 3, 2005

(54) WOODEN POST PROTECTIVE SLEEVE

(76) Inventors: Michael John, 8760 Junipero Ave., Atascadero, CA (US) 93422; Sharianne John, 8760 Junipero Ave., Atascadero, CA (US) 93422

( * ) Notice: Subject to any disclaimer, the term of this patent is extended or adjusted under 35 U.S.C. 154(b) by 348 days.

(21) Appl. No.: 09/637,674

(22) Filed: Aug. 14, 2000

(51) Int. Cl.[7] ..... E02D 27/42

(52) U.S. Cl. ..... 52/170; 52/165; 52/169.13; 52/721.5; 52/723.2; 52/726.1; 52/736.4; 52/737.5; 248/519; 248/530; 256/65

(58) Field of Search ..... 52/165, 170, 169.14, 52/298, 736.4, 40

(56) References Cited

U.S. PATENT DOCUMENTS 574,641 A * 1/1897 Streator
725,820 A * 4/1903 Beazley
772,928 A * 10/1904 Dunlap
1,230,475 A * 6/1917 Gardner
2,724,156 A * 11/1955 Shaw
3,615,110 A * 10/1971 Fugate
4,386,762 A * 6/1983 Collins ..... 256/59
4,516,365 A * 5/1985 Chapman ..... 51/170
4,543,757 A * 10/1985 Cosgrove ..... 52/295
4,722,514 A * 2/1988 Pettit ..... 256/50
4,845,889 A * 7/1989 Taylor ..... 47/23
5,311,713 A * 5/1994 Goodrich ..... 52/301
5,315,796 A * 5/1994 Gruhlke ..... 52/170
5,503,371 A * 4/1996 Bies ..... 256/1
5,568,909 A * 10/1996 Timko ..... 248/519
5,720,134 A * 2/1998 Kurtz ..... 52/170
5,733,613 A * 3/1998 Baecker ..... 428/34.9
6,098,351 A * 8/2000 Mills ..... 52/169.14
6,098,353 A * 8/2000 Stanfield ..... 52/170
6,176,062 B1 * 1/2001 Fayle ..... 52/736.4
6,260,328 B1 * 7/2001 Fowler et al. ..... 52/732.1
6,389,760 B1 * 5/2002 McDonnell ..... 52/165
6,401,411 B1 * 6/2002 Maglio, Jr. ..... 52/297
6,543,391 B2 * 4/2003 Lesko ..... 119/791
2002/0139069 A1 * 10/2002 Buffkin et al. ..... 52/170

* cited by examiner

*Primary Examiner*—Carl D. Friedman
*Assistant Examiner*—Yvonne M. Horton
(74) *Attorney, Agent, or Firm*—Goldstein Law Offices, P.C.

(57) ABSTRACT

A wooden post protective sleeve including a collar having an open upper end, a closed lower end, and a surrounding side wall. The open upper end is dimensioned for receiving the lower end of the wooden post therein. The surrounding side wall has a plurality of apertures therethrough downwardly of the open upper end. The apertures are dimensioned for receiving wood screws therethrough for engaging the lower end of the wooden post. The closed lower end has a plurality of drainage apertures therethrough. The drainage apertures include a central aperture and four peripheral apertures. The collar is fabricated of plastic.

4 Claims, 3 Drawing Sheets

WOODEN POST PROTECTIVE SLEEVE

BACKGROUND OF THE INVENTION

The present invention relates to a wooden post protective sleeve and more particularly pertains to protecting a lower end of a wooden post from rotting while positioned within a hole in a ground area while also making insertion into and removal from the hole easier.

The use of support devices for ground anchors is known in the prior art. More specifically, support devices for ground anchors heretofore devised and utilized for the purpose of providing support to ground anchors are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,203,817 to Klumpjan discloses a fence post bracket capable of holding the post above ground level to provide complete drainage and minimize deterioration. U.S. Pat. No. 5,720,134 to Kurtz discloses a structural support post with a plastic base to prevent rotting from moisture. U.S. Pat. No. 5,733,613 to Baecker discloses a plastic sleeve for a wood pole to prevent deterioration.

While these devices fulfill their respective, particular objective and requirements, the aforementioned patents do not describe a wooden post protective sleeve for protecting a lower end of a wooden post from rotting while positioned within a hole in a ground area while also making insertion into and removal from the hole easier.

In this respect, the wooden post protective sleeve according to the present invention substantially departs from the conventional concepts and designs of the prior art, and in doing so provides an apparatus primarily developed for the purpose of protecting a lower end of a wooden post from rotting while positioned within a hole in a ground area while also making insertion into and removal from the hole easier.

Therefore, it can be appreciated that there exists a continuing need for a new and improved wooden post protective sleeve which can be used for protecting a lower end of a wooden post from rotting while positioned within a hole in a ground area while also making insertion into and removal from the hole easier. In this regard, the present invention substantially fulfills this need.

SUMMARY OF THE INVENTION

In the view of the foregoing disadvantages inherent in the known types of support devices for ground anchors now present in the prior art, the present invention provides an improved wooden post protective sleeve. As such, the general purpose of the present invention, which will be described subsequently in greater detail, is to provide a new and improved wooden post protective sleeve which has all the advantages of the prior art and none of the disadvantages.

To attain this, the present invention essentially comprises a collar having a generally rectangular configuration. The collar has an open upper end, a closed lower end, and four surrounding side walls. The open upper end is dimensioned for receiving the lower end of the wooden post therein. The four surrounding side walls each have an aperture therethrough downwardly of the open upper end. The apertures are dimensioned for receiving wood screws therethrough for engaging the lower end of the wooden post. The closed lower end has a plurality of drainage apertures therethrough.

The drainage apertures include a central aperture and four corner apertures. The collar is fabricated of plastic.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wooden post protective sleeve which has all the advantages of the prior art support devices for ground anchors and none of the disadvantages.

It is another object of the present invention to provide a new and improved wooden post protective sleeve which may be easily and efficiently manufactured and marketed.

It is a further object of the present invention to provide a new and improved wooden post protective sleeve which is of durable and reliable construction.

An even further object of the present invention is to provide a new and improved wooden post protective sleeve which is susceptible of a low cost of manufacture with regard to both materials and labor, and which accordingly is then susceptible of low prices of sale to the consuming public, thereby making such a wooden post protective sleeve economically available to the buying public.

Even still another object of the present invention is to provide a new and improved wooden post protective sleeve for protecting a lower end of a wooden post from rotting while positioned within a hole in a ground area while also making insertion into and removal from the hole easier.

Lastly, it is an object of the present invention to provide a new and improved wooden post protective sleeve including a collar having an open upper end, a closed lower end, and a surrounding side wall. The open upper end is dimensioned for receiving the lower end of the wooden post therein. The surrounding side wall has a plurality of apertures therethrough downwardly of the open upper end. The apertures are dimensioned for receiving wood screws therethrough for engaging the lower end of the wooden post. The closed lower end has a plurality of drainage apertures therethrough. The drainage apertures include a central aperture and four peripheral apertures. The collar is fabricated of plastic.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 1:
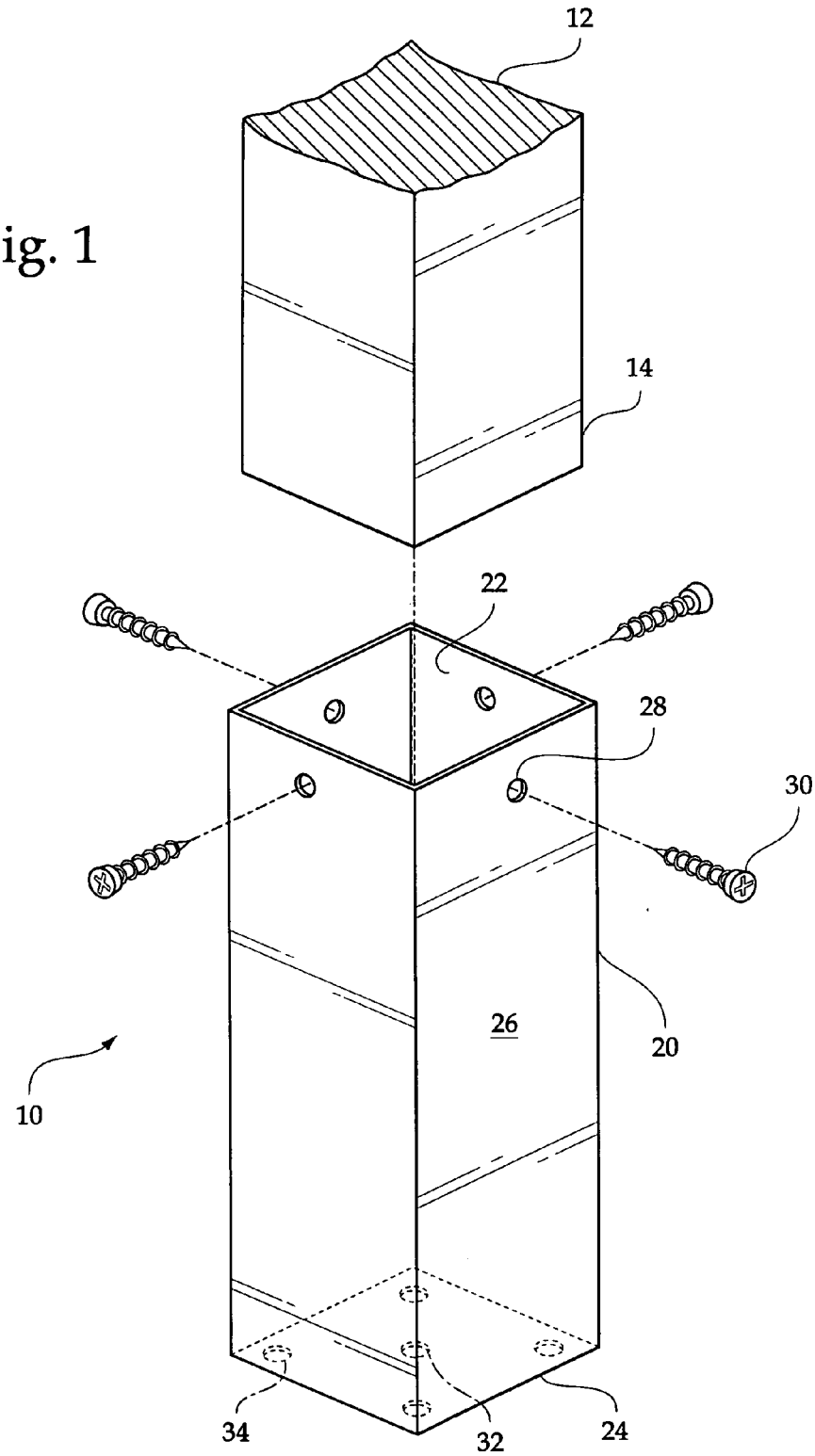
FIG. 1 is an exploded perspective view of the preferred embodiment of the wooden post protective sleeve constructed in accordance with the principles of the present invention.
Figure 2:
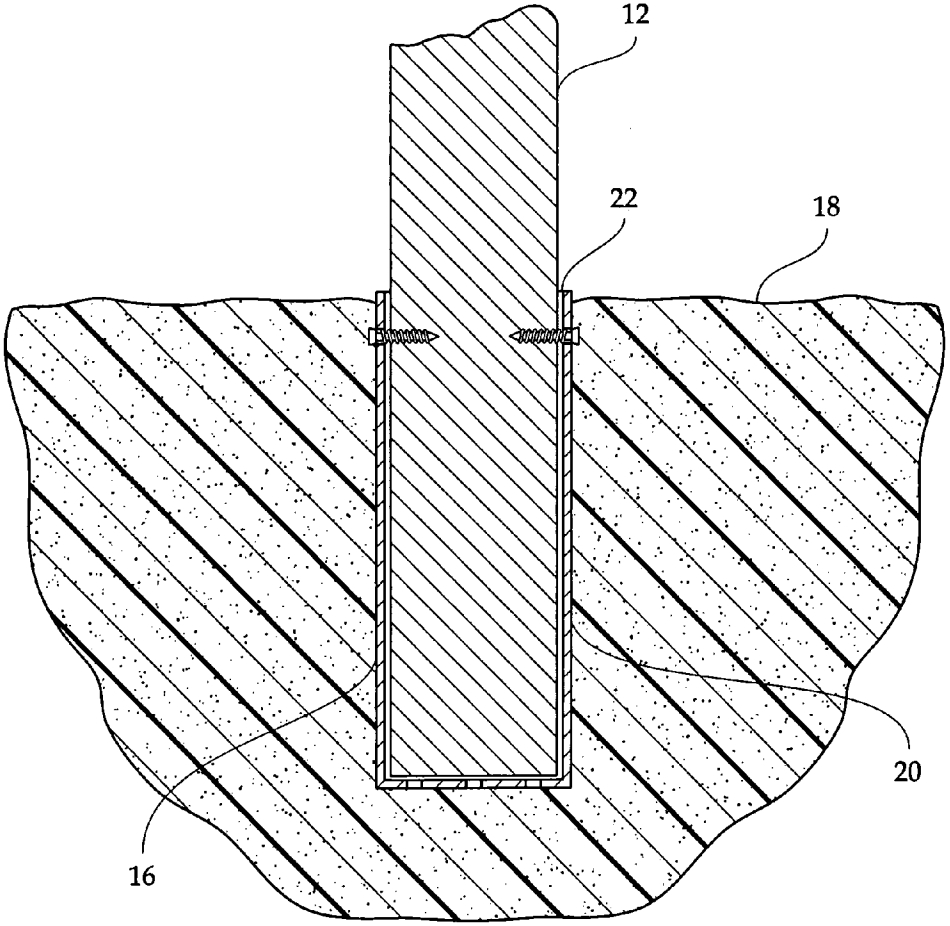
FIG. 2 is a side cross-sectional view of the present invention illustrated in use.
Figure 3:
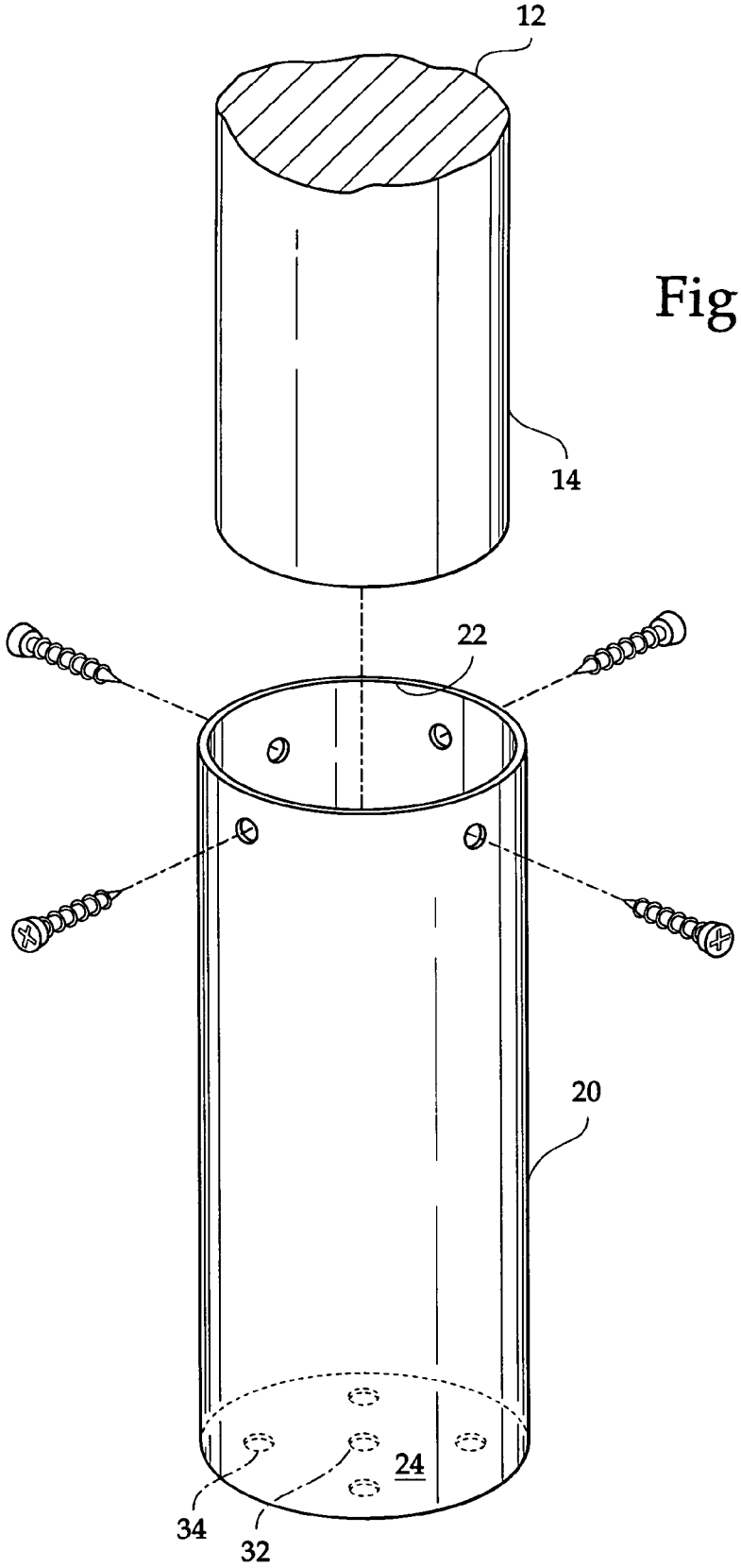
FIG. 3 is an exploded perspective view of a second embodiment of the present invention.

With reference now to the drawings, and in particular, to FIGS. 1 through 3 thereof, the preferred embodiment of the new and improved wooden post protective sleeve embodying the principles and concepts of the present invention and generally designated by the reference number 10 will be described.

Specifically, it will be noted in the various figures that the device relates to a wooden post protective sleeve for protecting a lower end of a wooden post from rotting while positioned within a hole in a ground area while also making insertion into and removal from the hole easier.

The present invention is designed for use with a wooden post 12 that has a lower end 14 that is ordinarily positioned within a hole 16 that has been dug in a ground area 18. An upper end of the wooden post 12 normally supports an item, such as a mailbox, thereon. The wooden post 12 could also be a single component of a plurality of posts used to make up a fence.

The present invention is essentially comprised of a collar 20 having a generally rectangular configuration. The collar 20 has an open upper end 22, a closed lower end 24, and four surrounding side walls 26. The open upper end 22 is dimensioned for receiving the lower end 14 of the wooden post 12 therein. The four surrounding side walls 26 each have an aperture 28 therethrough downwardly of the open upper end 22. The apertures 28 are dimensioned for receiving wood screws 30 therethrough for engaging the lower end 14 of the wooden post 12. The closed lower end 24 has a plurality of drainage apertures therethrough. The drainage apertures include a central aperture 32 and four corner apertures 34. The collar 20 is fabricated of plastic.

A second embodiment of the present invention is shown in FIG. 3 and includes substantially all of the components of the present invention except that the wooden post 12 and the collar are each cylindrical instead of rectangular. It should be noted that the collar can be shaped to correspond with any shape of wooden post. The closed lower end 24 of the collar includes a central aperture 32 and four peripheral apertures 34.

In use, the hole 16 is dug within the ground area 18 that will accommodate the wooden post 12 and the collar 20. The collar 20 will not increase the dimensions of the post 12 a great deal. The collar 20 is quite thin and is anything but cumbersome. The lower end 14 of the post 12 is then positioned within the collar 20 leaving a small area between the lower end 14 of the post 12 and the closed lower end 24 of the collar 20. This will allow any accumulated water and moisture to exit the collar 20 and not have an adverse effect on the wooden post 12. The wood screws 30 are then positioned through the apertures 28 to engage the post 12. The post 12 can then be positioned within the hole 16 and filled to support the post 12 in an upright orientation. Note FIG. 2.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A wooden post protective sleeve for protecting a lower end of a wooden post from rotting while positioned within a hole in a ground area while also making insertion into and removal from the hole easier, comprising:

a collar having a generally rectangular configuration, the collar having an open upper end, a closed lower end, and four surrounding side walls, the open upper end being dimensioned for receiving the lower end of the wooden post therein, the four surrounding side walls each having an aperture therethrough downwardly of the open upper end, the apertures being dimensioned for receiving wood screws therethrough for engaging the lower end of the wooden post, the closed lower end having a plurality of drainage apertures therethrough for allowing any water on the sleeve or the wooden post to drain into the ground area, the drainage apertures including a central aperture and four corner apertures, the collar being fabricated of plastic.

2. A wooden post protective sleeve for protecting a lower end of a wooden post from rotting while positioned within a hole in a ground area while also making insertion into and removal from the hole easier, comprising:

a collar having an open upper end, a closed lower end, and a surrounding side wall, the open upper end being dimensioned for receiving the lower end of the wooden post therein, the surrounding side wall having a plurality of apertures therethrough downwardly of the open upper end, the apertures being dimensioned for receiving wood screws therethrough for engaging the lower end of the wooden post, the closed lower end having a plurality of drainage apertures therethrough for allowing any water on the sleeve or the wooden post to drain into the ground area, the drainage apertures including a central aperture and four peripheral apertures, the collar being fabricated of plastic.

3. The wooden post protective sleeve as set forth in claim 2, wherein the collar and the wooden post each has a rectangular configuration.

4. The wooden post protective sleeve as set forth in claim 2, wherein the collar and the wooden post each has a cylindrical configuration.

* * * * *